US005813417A

United States Patent [19]

Rudolph

[11] Patent Number: 5,813,417

[45] Date of Patent: Sep. 29, 1998

[54] HAIR CUTTING METHOD

[76] Inventor: James M. Rudolph, 1150 Beacon St., Brea, Calif. 92621

[21] Appl. No.: 946,556

[22] Filed: Oct. 7, 1997

[51] Int. Cl.[6] ..... A45D 24/00

[52] U.S. Cl. ..... 132/200; 132/213; 132/213.1; 132/212; 132/214; 30/261

[58] Field of Search ..... 132/213, 214, 132/212, 200, 213.1; 83/13, 915, 34; 30/261, 253, 262; 81/415, 416, 417; 287/117, 60

[56] References Cited

U.S. PATENT DOCUMENTS

| | | | |
|---|---|---|---|
| 664,613 | 12/1900 | Badger | 30/261 |
| 2,749,612 | 6/1956 | Griffon | 30/261 |
| 3,825,020 | 7/1974 | Myers | 132/200 |
| 3,921,478 | 11/1975 | Ygfors | 30/261 |
| 3,972,337 | 8/1976 | Pomaro | 132/213.1 |
| 4,299,030 | 11/1981 | Vickers | 30/261 |
| 5,002,554 | 3/1991 | Korber | 30/261 |
| 5,232,000 | 8/1993 | Chiavaras et al. | 132/200 |

FOREIGN PATENT DOCUMENTS

| | | | |
|---|---|---|---|
| 402695 | 9/1924 | Germany | 30/261 |
| 1582 | 5/1872 | United Kingdom | 30/261 |

*Primary Examiner*—Gene Mancene
*Assistant Examiner*—Pedro Philogene
*Attorney, Agent, or Firm*—John J. Connors; Connors & Assoc.

[57] ABSTRACT

A hair cutting method includes positioning a strand of hair between normally open blade ends of a scissors. The scissors have a pair of elongated members, each member having a blade end, an intermediate gripping section, and a spring end. Each blade end has a cutting edge. The elongated members are connected to each other by a pivot element disposed near a junction where the blade ends and intermediate gripping sections join. The spring ends each have tips which are connected together to bias the elongated members, so that the blade ends move about the pivot element into an open position. The blade ends come together in a cutting fashion with their cutting edges engaging to trim the edge of the nail upon the user grasping both intermediate gripping sections between the user's thumb and a finger of the user and pressing the intermediate gripping sections towards each other. Each blade end as measured from a tip of the blade to the point of connection with the pivot element has a length exceeding two inches.

6 Claims, 3 Drawing Sheets

HAIR CUTTING METHOD

BACKGROUND OF THE INVENTION

1. Field of the Invention

This invention relates to a method of cutting hair.

2. Background Discussion

In cutting hair it is common practice to use a scissors to cut strands of hair. Using conventional scissors requires the barber to twist her or his wrist into uncomfortable positions in order to properly cut the hair. With repeated, daily cutting the hair of many customers, this may lead to a muscle strain, or even more serious injuries to the wrist and arm of the barber.

SUMMARY OF THE INVENTION

It is the objective of this invention to provide a hair cutting method using a scissors which is easy, convenient, and comfortable to grip and manipulate and which avoids muscle strain. Moreover, greater control is attained using this scissors.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience of use and avoidance of muscle strain.

The hair cutting method of this invention is used to cut strands of hair in a more convenient manner. It includes positioning a stand of hair between normally open blade ends of a scissors designed especially to avoid muscle strain. This is accomplished by allowing the user to activate cutting action by simply squeezing together between the thumb and a finger gripping sections of the scissors to bring the blade ends into cutting engagement to cut the strand of hair. Upon the user relaxing his or her grip while still holding the scissors, the blade ends return to the open position due to spring action.

The scissors has a pair of elongated members. Each member has a blade end, an intermediate or central gripping section, and a spring end. Each blade end has a cutting edge. The blade ends, gripping sections, and spring ends in each elongated member are formed from a unitary piece of steel, with the spring end being a thin, curved member which is capable of flexing and returning to an unflexed condition. The gripping sections are substantially thicker than the spring ends and are rigid.

The elongated members are connected to each other by a pivot element, such as a screw, disposed near a junction where the blade ends and central gripping sections join. The spring ends each have tips which are connected together to bias the elongated members, so that the blade ends move about the pivot element into an open position. The blade ends come together in a cutting fashion with their cutting edges engaging to the strand of hair upon the user grasping both central gripping sections between the user's thumb and a finger of the user and pressing the central gripping sections towards each other. There is a stop element extending from the inside of one of the gripping sections which limits the movement of the gripping sections toward each other. Upon the user releasing or relaxing his or her grip of the central gripping sections while still holding the scissors, the blade ends return to their open position due to the spring action of the spring ends.

Each blade end as measured from a tip of the blade to the point of connection with the pivot element has a length exceeding two inches. Preferably, the tips of the blades are rounded. Preferably, the length of each of the blade ends is equal and has a length ranging between 2.0 inch and 5 inches. The combined length of the gripper sections and spring ends as measured from the pivot element to the tip of the spring ends ranges between 3 and 5 inches.

DESCRIPTION OF THE DRAWING

The preferred embodiment of this invention, illustrating all its features, will now be discussed in detail. This embodiment depicts the novel and non-obvious hair cutting method of this invention as shown in the accompanying drawing, which is for illustrative purposes only. This drawing includes the following figures (FIGS.), with like numerals indicating like parts.

DETAILED DESCRIPTION OF THE PREFERRED EMBODIMENT

Figure 1:
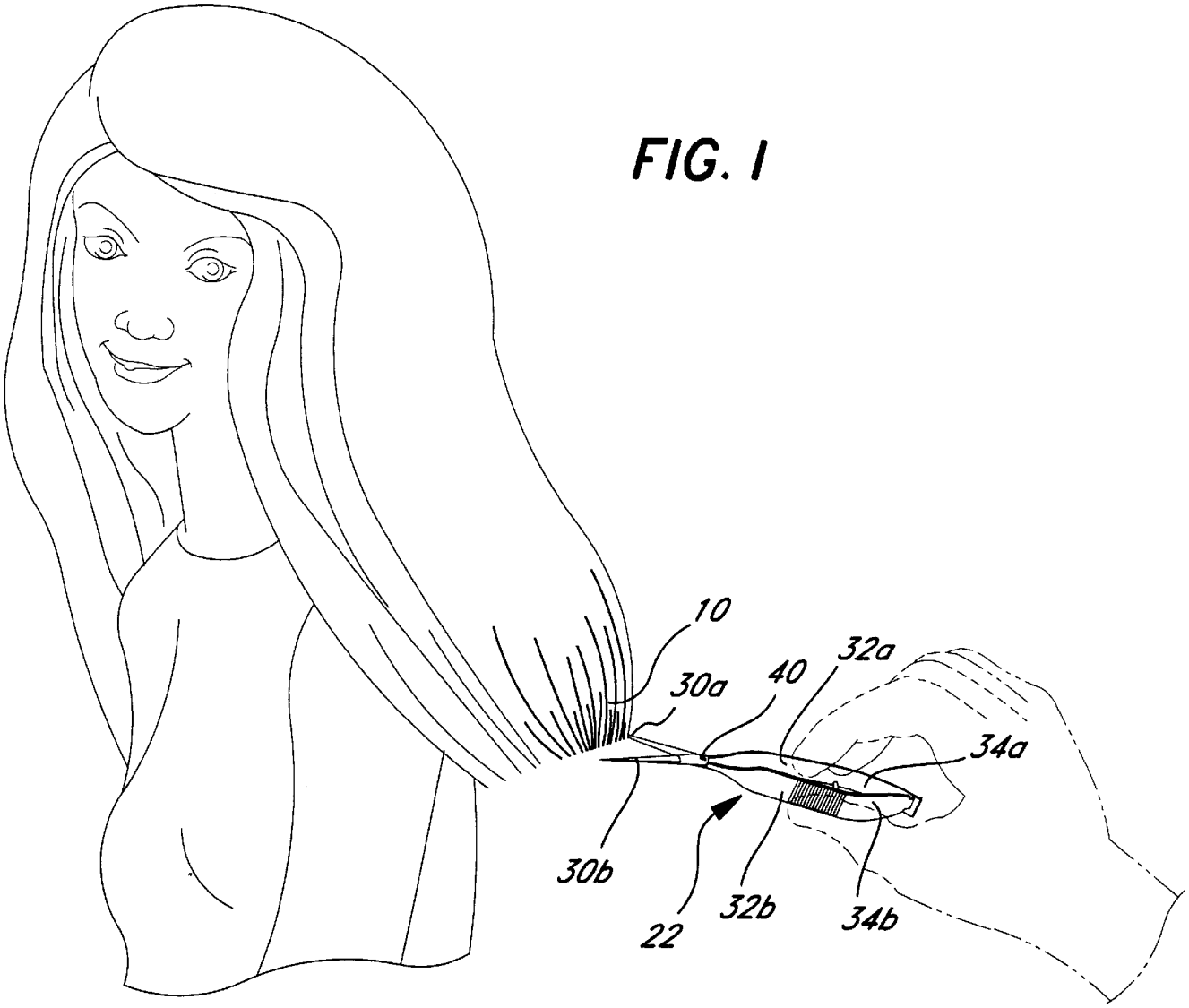
FIG. 1 is a schematic view depicting the novel hair cutting method of this invention.
Figure 2:
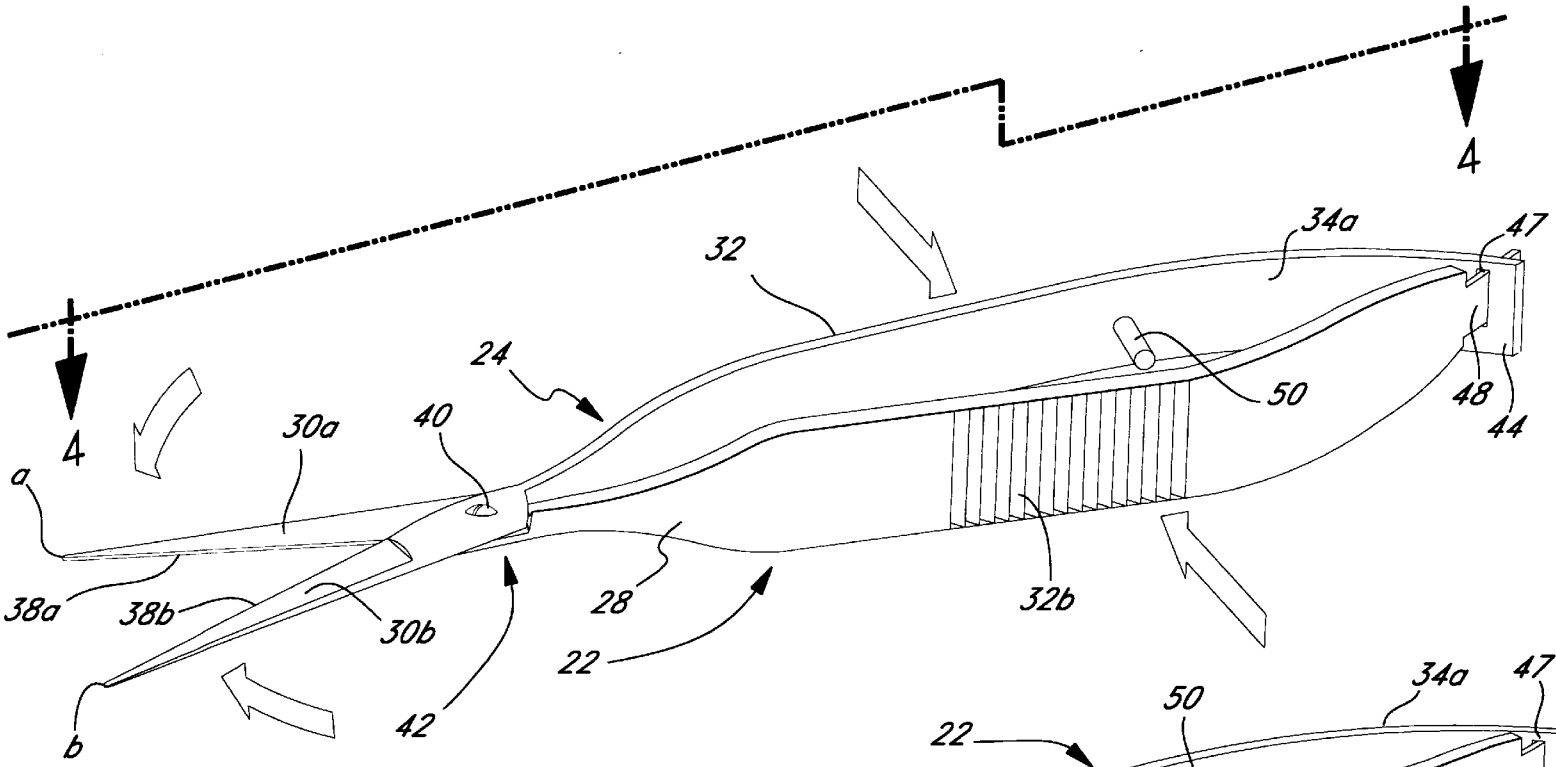
FIG. 2 is a perspective view of the scissors used to preform the method this invention in an open position.
Figure 3:
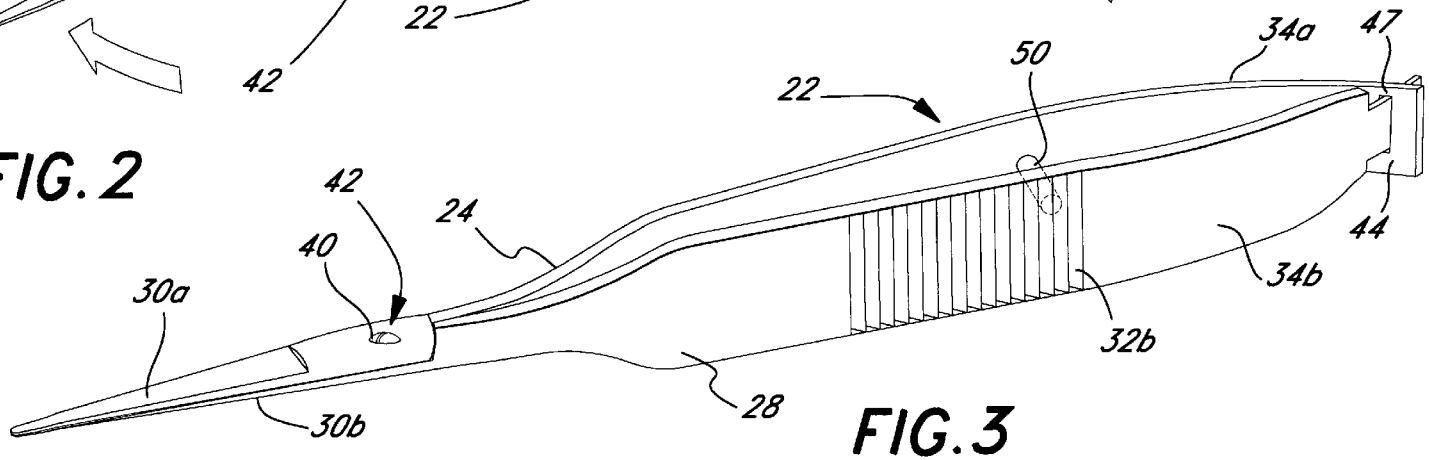
FIG. 3 is a perspective view of the scissors used to preform the method this invention in a closed position.
Figure 4:
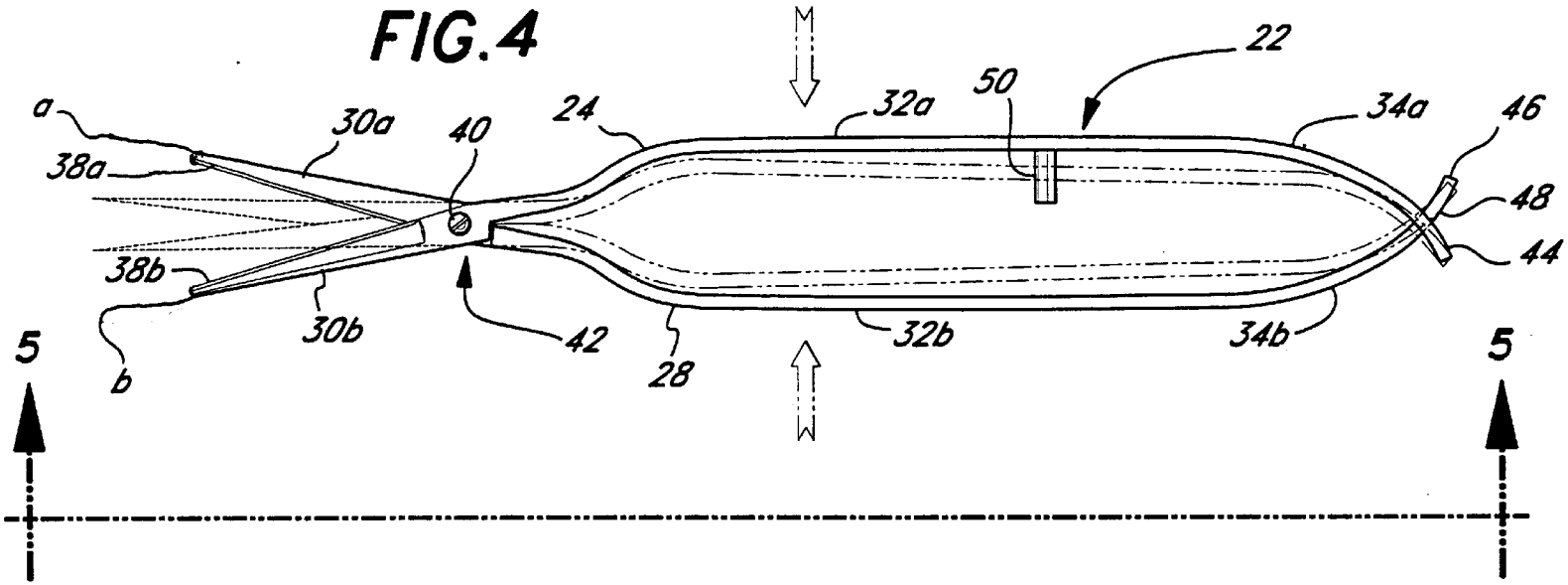
FIG. 4 is a plan view of the scissors used to preform the method this invention taken along line 4—4 of FIG. 2.
Figure 5:
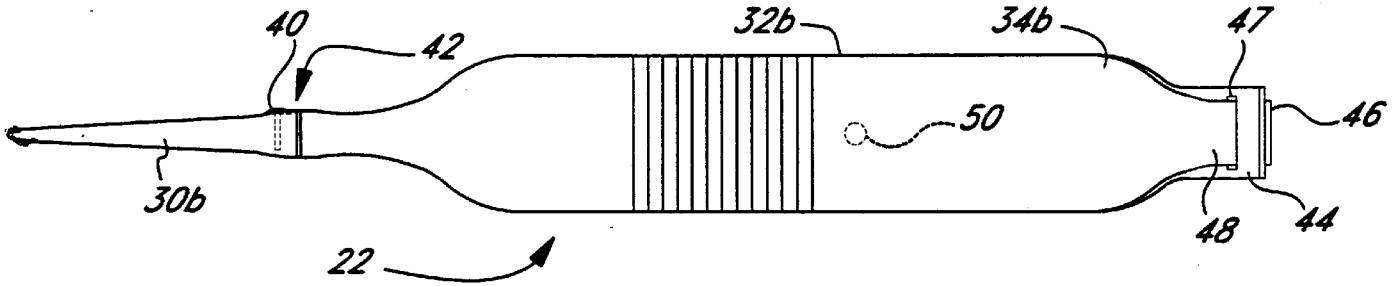
FIG. 5 is a side view of the scissors used to preform the method this invention taken along line 5—5 of FIG. 4.

As depicted in FIG. 1, a novel scissors 22 is used to cut stands of hair 10 in accordance with the method of this invention. As best shown in FIGS. 2 through 5, the scissors 22 includes a pair of elongated members 24 and 28. Each member has a blade end 30*a*, 30*b*, an intermediate or central gripping section 32*a*, 32*b*, and a spring end 34*a*, 34*b*. Each blade end 30*a*, 30*b* has a cutting edge 38*a*, 38*b* (FIGS. 3 and 5). The blade ends 30*a*, 30*b*, gripping sections 32*a*, 32*b*, and spring ends 34*a*, 34*b* are formed in each elongated member 24 and 28, respectively, from a unitary piece of steel, with each spring end being a thin, curved member which is capable of flexing under an applied force and returning to its unflexed condition when the applied force is removed. The gripping sections 32*a*, 32*b* are substantially thicker than the spring ends 34*a*, 34*b* and are rigid.

The elongated members 24 and 28 are connected to each other by a pivot element, such as a screw 40, disposed near the junction 42 where the blade ends 30*a*, 30*b* and central gripping sections 32*a*, 32*b* join. Each blade end 30*a*, 30*b*, as measured from the tips a, b, respectively, of these blade ends to the point of connection with the screw 40 has a length exceeding two inches. Preferably, the tips a and b are rounded, and the length of each of the blade ends is equal and has a length ranging between 2.0 inch and 5 inches. The length of the blade ends 30*a*, 30*b* is important to enable the user to cut effectively the hair strand 10. To short of a blade end would make it too difficult to cut the hair strand 10. The combined length of the gripper sections 32*a*, 32*b* and spring ends 34*a*, 34*b* as measured from the screw 40 to the tips of the spring ends ranges between 3 and 5 inches. In the embodiment depicted, the length of the blade ends 30*a*, 30*b* is approximately 3.0 inches.

The spring ends 34*a*, 34*b* each have tips 44 and 46, respectively, which are connected together. In the embodiment illustrated, the end 44 has a square opening 47 therein and the end 46 has a finger member 48 which is force fitted into this opening. This flexes the spring ends 34*a*, 34*b* inward towards each other to bias the elongated members 24 and 28, so that the blade ends 30*a*, 30*b* normally rotate about the screw 40 into an open position as illustrate in FIG. 2.

As depicted in FIGS. 2*a* and 2*b*, the blade ends 30*a*, 30*b* come together in a cutting fashion with their cutting edges 38*a*, 38*b* engaging to cut thew hair strand 10 upon the user grasping both central gripping sections 32*a*, 32*b* between the user's thumb and, for example, a finger of the user, preferably, either the index or middle finger, or both, and pressing the intermediate gripping sections 32*a*, 32*b* towards each other. Pressing the gripping sections 32*a*, 32*b* towards each other moves the elongated members 24 and 28 from the position shown in solid lines in FIG. 4 to the position shown in dotted lines in FIG. 4. Upon release or relaxing this grasp, the spring ends 34*a*, 34*b* force the elongated members 24 and 28 to return to the position shown in solid lines in FIG. 4. Thus, the blade ends 30*a*, 30*b* are normally in the open position shown in solid lines in FIG. 4. There is a stop post 50 extending from the inside surface of the gripping section 32*b*. When the gripping sections 32*a*, 32*b* are pushed towards each other and the blade ends 30*a*, 30*b* engage in cutting action as illustrated in FIG. 3, this stop post 50 engages the inside surface of the gripping section 32*a* to limit the movement of the gripping sections toward each other.

To accomplish the method of this invention, the user first position a strand of hair 10 between normally open blade ends 30*a*, 30*b* of the scissors 22. Next, the user presses the gripping sections 32*a*, 32*b* using his or her thumb and a finger to pushes these sections towards each other. The blade ends 30*a*, 30*b* come together in a cutting action to sever the strand of hair 10 between these ends. The user then relaxes or releases his or her grip on the gripping sections 32*a*, 32*b* while still holding the scissors 22, causing the blade ends to return to the open position due to the action of the spring ends 34*a*, 34*b*. Cutting the hair strand 10 in this fashion enables the user to manipulate the scissors easily into different positions as required to cut the hair strand 10 into the desired shape while avoiding muscle strain by allowing the user to simply activate cutting action by squeezing and relaxing his or her grip on the gripping sections 32*a*, 32*b* of the scissors 22.

A scissors similar to scissors 22 was developed for cutting finger nails as described in a co-pending application of the inventor filed on the same date as this application. The main difference between the scissors used to cut finger nails and the scissors 22 used in connection with cutting hair is that the blade ends 30*a* and 30*b* are at least two inches in length as measured from the tips a, b, respectively, of these blade ends to the point of connection with the screw 40.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A hair cutting method including (a) positioning strands of hair between normally open blade ends of a scissors having a pair of elongated members, each member having a blade end, a intermediate gripping section, and a spring end, and each blade end having a cutting edge, said members being connected to each other by a pivot element disposed near a junction where the blade ends and intermediate gripping sections join, and said spring ends each having tips which are connected together to bias said elongated members so that the blade ends move about the pivot element into a normally open position, said blade ends coming together in a cutting fashion with their cutting edges engaging upon the user grasping both intermediate gripping sections between the user's thumb and a finger of the user and pressing said intermediate gripping sections towards each other, said blade ends returning to the normally open position upon the user relaxing his or her grasp of said intermediate gripping sections, (b) grasping both intermediate gripping sections between the user's thumb and a finger of the user and pressing said intermediate gripping sections towards each other to bring the cutting edges into engagement to cut said strands of hair, and (c) relaxing the grip of the intermediate gripping sections while still holding the scissors to allow the blade ends to return to the normally open position, thereby allowing the user to reposition the scissors to cut additional stands of hair as desired.

2. The method of claim 1 where each blade end as measured from a tip of the blade end to the point of connection with said pivot element has a length exceeding two inches.

3. The method of claim 2 where the length of each said blade end is equal and has a length ranging between 2.0 inch and 5 inches.

4. The method of claim 3 where the combined length of the gripper sections and spring ends as measured from the pivot element to tips of the spring ends ranges between 3 and 5 inches.

5. The method of claim 2 where the tip of end blade end is rounded.

6. A hair cutting method wherein an a strand of hair is positioned between open blade ends of a scissors having a spring mechanism which normally bias said blade ends into an open position and gripping sections of the scissors are grasped between a user's thumb and a finger of the user and pressed together towards each other to bring the cutting edges into engagement to cut the strand of hair, the grip on the intermediate gripping sections being relaxed by the user while still holding the scissors to allow the blade ends to return to the normally open position, said user repositioning the scissors to cut additional strands of hair as desired.

* * * * *